US008879934B2

(12) United States Patent
Kameda et al.

(10) Patent No.: US 8,879,934 B2
(45) Date of Patent: Nov. 4, 2014

(54) IMAGE FORMING APPARATUS

(75) Inventors: Seiichiro Kameda, Abiko (JP); Kohei Koshida, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 280 days.

(21) Appl. No.: 13/224,753

(22) Filed: Sep. 2, 2011

(65) Prior Publication Data

US 2012/0057887 A1 Mar. 8, 2012

(30) Foreign Application Priority Data

Sep. 7, 2010 (JP) ..... 2010-200123

(51) Int. Cl.
*G03G 15/00* (2006.01)
*G03G 15/20* (2006.01)

(52) U.S. Cl.
CPC .... *G03G 15/2028* (2013.01); *G03G 2215/0129* (2013.01)
USPC ..... 399/44; 399/322; 399/45

(58) Field of Classification Search
USPC ..... 399/405, 406, 91, 341, 44, 45, 322, 399/323, 94, 97; 400/642; 219/539, 541, 219/544
See application file for complete search history.

(56) References Cited

U.S. PATENT DOCUMENTS

| | | | | |
|---|---|---|---|---|
| 1,067,869 | A * | 7/1913 | Falkenberg | 338/247 |
| 5,623,332 | A * | 4/1997 | Kawaguchi | 399/308 |
| 5,768,659 | A | 6/1998 | Kameda | |
| 8,278,607 | B2 * | 10/2012 | Choh | 219/539 |
| 2008/0156325 | A1 * | 7/2008 | Galauner et al. | 128/203.27 |
| 2010/0237063 | A1 * | 9/2010 | Hasegawa et al. | 219/549 |

FOREIGN PATENT DOCUMENTS

| | | | | |
|---|---|---|---|---|
| JP | 03225385 | A * | 10/1991 | G03G 15/20 |
| JP | 2002-148973 | | 5/2002 | |
| JP | 2007-187821 | | 7/2007 | |

OTHER PUBLICATIONS

Machine translation of Yamakawa et al., JP 2007-187821.*
Abstract of Saito et al., JP 03-225385.*
Office Action in Chinese Patent Application No. 201110258056.3, dated Dec. 2, 2013 (with English translation).

* cited by examiner

*Primary Examiner* — David Gray
*Assistant Examiner* — Sevan A Aydin
(74) *Attorney, Agent, or Firm* — Fitzpatrick, Cella, Harper & Scinto

(57) ABSTRACT

An image forming apparatus, including: a fixing device configured to fix a toner image onto a sheet by heating the sheet having the toner image formed thereon; a wire-shaped guide configured to guide the sheet having the toner image fixed thereto; and a holder, configured to hold the wire-shaped guide, to which the wire-shaped guide is fixed by using elasticity of the wire-shaped guide.

11 Claims, 14 Drawing Sheets

IMAGE FORMING APPARATUS

BACKGROUND OF THE INVENTION

1. Field of the Invention

The present invention relates to an image forming apparatus for forming an image on a sheet.

2. Description of the Related Art

Conventionally, an image forming apparatus such as a copying machine and a printer for forming a toner image on a sheet by using an electrophotographic process includes a heat fixing device configured to fix, onto the sheet, an unfixed toner image formed on the sheet by heating and fixing the sheet and the toner image. Meanwhile, the sheet contains moisture. Therefore, when the sheet is heated by the fixing device, the moisture contained in the sheet vaporizes and adheres to a guide member, which adjoins the fixing device on the downstream side of the fixing device to guide the sheet. Such moisture may be condensed and result in a water droplet.

When the water droplet due to the moisture condensation adheres to the sheet passing through the guide member, particularly in a case where images are formed on both sides of the sheet, electric charges are not sufficiently applied to the sheet, and text blanking (blank area) occurs, which causes degradation of image quality. Further, when the water droplet adheres to the sheet, the sheet sticks to the guide member to cause a sheet jam.

Therefore, Japanese Patent Application Laid-Open No. 2007-187821 discloses a guide chute which causes less moisture condensation. The guide chute includes wire-shaped members coated with a resin, extending along a sheet conveying direction, and having a cornerless, convex cross-sectional shape on a sheet conveying path side, and holders having the wire-shaped members arranged on a plane along the sheet conveying path while the wire-shaped members are spaced apart from one another with a space. The wire-shaped member is formed by coating a metal with a resin. By the way, the image forming apparatus is becoming downsized nowadays, and the guide chute is also required to be downsized. Further, in the vicinity of the downstream side of the fixing device in the sheet conveying direction, there are provided a guide plate having added thereto a function of separating the sheet from the fixing device, and a conveyance roller for preventing the sheet jam, sheet corner folding, and sheet curling. Therefore, the installation space for the guide chute is narrow, and hence the demand for downsizing the guide chute is increasing much more.

The guide chute disclosed in Japanese Patent Application Laid-Open No. 2007-187821 is formed by welding the wire-shaped members to the holders. However, it is necessary to downsize the wire-shaped members and the holders for downsizing the guide chute. Thus, it is difficult to weld the wire members to the holders, which requires labor and time for the manufacturing.

Further, the wire-shaped member disclosed in Japanese Patent Application Laid-Open No. 2007-187821 is formed by coating a metal cored wire with a resin, and hence the cored wire needs to be coated with the resin after the cored wire is welded to the holder. Otherwise, the resin may be melted by heat of the welding. However, when the cored wire is coated with the resin after the welding, it is difficult to keep the coating thickness uniform, which may result in an uneven surface. Accordingly, in the conventional wire-shaped member, the leading edge of the sheet conveyed through the fixing device is engaged with the uneven surface of the wire-shaped member, which may cause the sheet jam.

Further, an image forming apparatus including the guide chute which is likely to cause the sheet jam has the following problem inherent therein. That is, the image forming apparatus needs to form an image on the sheet again as many times as the sheet jam has occurred.

SUMMARY OF THE INVENTION

It is an object of the present invention to provide an image forming apparatus that is manufacturable with ease and capable of smoothly guiding a sheet with less moisture condensation even if moisture vaporized from the sheet when the sheet passes through a fixing device adheres.

An image forming apparatus according to the present invention includes: a fixing device configured to fix a toner image onto a sheet by heating the sheet having the toner image formed thereon; a wire-shaped guide configured to guide the sheet having the toner image fixed thereto; and a holder, configured to hold the wire-shaped guide, to which the wire-shaped guide is fixed by using elasticity of the wire-shaped guide.

Because the wire-shaped guide is fixed by the elasticity of the wire-shaped guide, the image forming apparatus of the present invention is manufacturable with ease.

Further features of the present invention will become apparent from the following description of exemplary embodiments with reference to the attached drawings.

DESCRIPTION OF THE EMBODIMENT

Preferred embodiments of the present invention will now be described in detail in accordance with the accompanying drawings.

Note that, numerical values to be presented in this embodiment are pro form a numerical values, and hence do not limit the present invention. Further, respective components disclose the best mode for carrying out the invention, and hence are not limited to those in this embodiment.

(Image Forming Apparatus)

Figure 1:
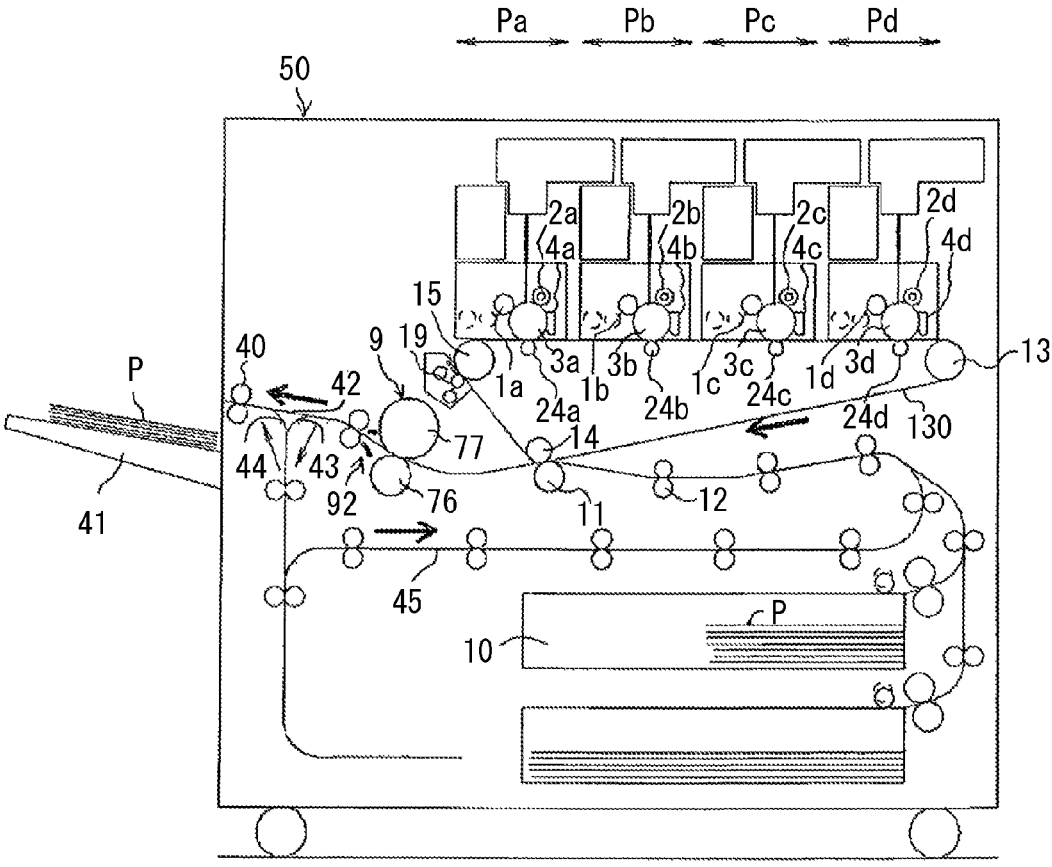
FIG. 1 is a cross-sectional view of an image forming apparatus according to an embodiment of the present invention, which is taken along a sheet conveying direction.

FIG. 1 is a cross-sectional view of the image forming apparatus according to the embodiment of the present invention, which is taken along a sheet conveying direction. An image forming apparatus 50 includes first to fourth image forming portions Pa, Pb, Pc, and Pd arranged in correspondence with cyan, magenta, yellow, and black, respectively. The image forming portions form toner images of the different colors to be overlaid sequentially on a transfer belt 130 through a process of forming latent images, development, and transfer.

The image forming portions Pa, Pb, Pc, and Pd include photosensitive drums 3*a*, 3*b*, 3*c*, and 3*d*, respectively. The toner images of the respective colors are formed on the corresponding photosensitive drums 3*a*, 3*b*, 3*c*, and 3*d*. The toner images of the respective colors formed on the corresponding photosensitive drums 3*a*, 3*b*, 3*c*, and 3*d* are primarily transferred onto the transfer belt 130 that is arranged adjacently to the photosensitive drums 3*a*, 3*b*, 3*c*, and 3*d*, and secondarily transferred onto a sheet P by a secondary transfer roller 11. The sheet P having the toner images transferred thereto is heated and pressurized by a fixing device 9 so that the toner images are fixed, and the resultant sheet P is delivered to the outside of the image forming apparatus 50.

On the outer circumferences of the photosensitive drums 3*a*, 3*b*, 3*c*, and 3*d*, drum charging devices 2*a*, 2*b*, 2*c*, and 2*d*, developing devices 1*a*, 1*b*, 1*c*, and 1*d*, primary transfer charging devices 24*a*, 24*b*, 24*c*, and 24*d*, and cleaners 4*a*, 4*b*, 4*c*, and 4*d* are provided, respectively. In an upper part of the image forming apparatus 50, light source devices (not shown) and polygon mirrors (not shown) are further provided.

Laser beams emitted from the light source devices are scanned by rotating the polygon mirrors. Beams of the scanning light are deflected by reflection mirrors, and then focused by fθ-lenses on generating lines of the photosensitive drums 3*a*, 3*b*, 3*c*, and 3*d* for light exposure, respectively. Through the light exposure, latent images according to image signals are formed on the photosensitive drums 3*a*, 3*b*, 3*c*, and 3*d*, respectively.

The developing devices 1*a*, 1*b*, 1*c*, and 1*d* are each loaded with predetermined amounts of a cyan toner, a magenta toner, a yellow toner, and a black toner as developers by supply devices (not shown). The developing devices 1*a*, 1*b*, 1*c*, and 1*d* respectively develop the latent images on the photosensitive drums 3*a*, 3*b*, 3*c*, and 3*d* to visualize the latent images as a cyan toner image, a magenta toner image, a yellow toner image, and a black toner image.

The transfer belt 130 is guided by rollers 13, 14, and 15 to circulate in the arrow direction at the same circumferential speed as that of the photosensitive drum 3*a*. The roller 15 is a driving roller, while the other rollers 13 and 14 are driven rollers.

The yellow toner image corresponding to the first color, which is formed on the photosensitive drum 3*a*, passes through a nip portion between the photosensitive drum 3*a* and the transfer belt 130. In the course of passing through the nip portion, the yellow toner image is primarily transferred onto the outer circumferential surface of the transfer belt 130 by an electric field formed by a primary transfer bias applied to the transfer belt 130, and a nip pressure between the photosensitive drum 3*a* and the transfer belt 130. Similarly, the magenta toner image corresponding to the second color, the cyan toner image corresponding to the third color, and the black toner image corresponding to the fourth color are sequentially transferred onto the transfer belt 130 in an overlapping manner. As a result, a composite color toner image corresponding to a target color image is formed on the transfer belt 130.

On the outer circumferential surface of the transfer belt 130, the secondary transfer roller 11 is arranged so as to come into contact with the transfer belt 130. The secondary transfer roller 11 has a secondary transfer bias applied thereto from a secondary transfer bias power source.

Meanwhile, the sheet P is sent out from a feed cassette 10, and passes through a registration roller pair 12 and a pre-transfer guide (not shown). Then, the sheet P is fed to a nip between the transfer belt 130 and the secondary transfer roller 11 at a predetermined timing, and at the same time, the secondary transfer bias is applied to the transfer belt 130. By the secondary transfer bias, the composite color toner image transferred onto the transfer belt 130 in an overlapping manner is secondarily transferred from the transfer belt 130 onto the sheet P as the composite color toner image.

The photosensitive drums 3*a*, 3*b*, 3*c*, and 3*d* after the termination of the primary transfer are cleaned by removing transfer residual toners respectively by the cleaners 4*a*, 4*b*, 4*c*, and 4*d*, and are continuously used for next formation of latent images. Further, the toners and other foreign materials remaining on the transfer belt 130 are wiped off by a cleaning web (non-woven fabric) 19 abutting against the surface of the transfer belt 130.

In the above-mentioned structure, the image forming portions Pa, Pb, Pc, and Pd, the transfer belt 130, the secondary transfer roller 11, and the like constitute an image forming unit.

The sheet P having the toner image transferred thereto is sent to the fixing device 9, and is heated and pressurized by the fixing device 9. As a result, the toner image is fixed onto the sheet P.

Further, the sheet P having the toner image fixed thereto is delivered to a delivery tray 41 by a delivery roller pair 40. Note that, the sheet may be delivered to the delivery tray 41 with the image formation surface facing upward (in a face-up state), and may also be delivered with the image formation surface facing downward (in a face-down state).

The sheet P is delivered face-up in such a manner that, after passing through the fixing device 9, the sheet P passes straight along a conveyance portion 42. The sheet P is delivered face-down in such a manner that, after passing through the fixing device 9, the sheet P is conveyed in a switchback manner in the arrow directions along conveyance portions 43 and 44, and the front surface and the rear surface of the sheet are reversed. The conveyance portions 42, 43, and 44 are selectively switched by a switching member (not shown).

Further, the sheet P may be delivered with the toner images formed on both sides of the sheet P. The toner images are formed on both sides of the sheet and the resultant sheet is delivered in the following manner. After the sheet passes through the fixing device 9 with the toner image formed on one surface of the sheet, the sheet is conveyed in a switchback manner while being conveyed along conveyance portions 43 and 45 so that the front surface and the rear surface of the sheet are reversed, and the sheet is sent to the nip between the transfer belt 130 and the secondary transfer roller 11. Then, the toner image is formed also on the other surface of the sheet, and the resultant sheet is delivered to the delivery tray 41.

(Fixing Device)

Figure 2:
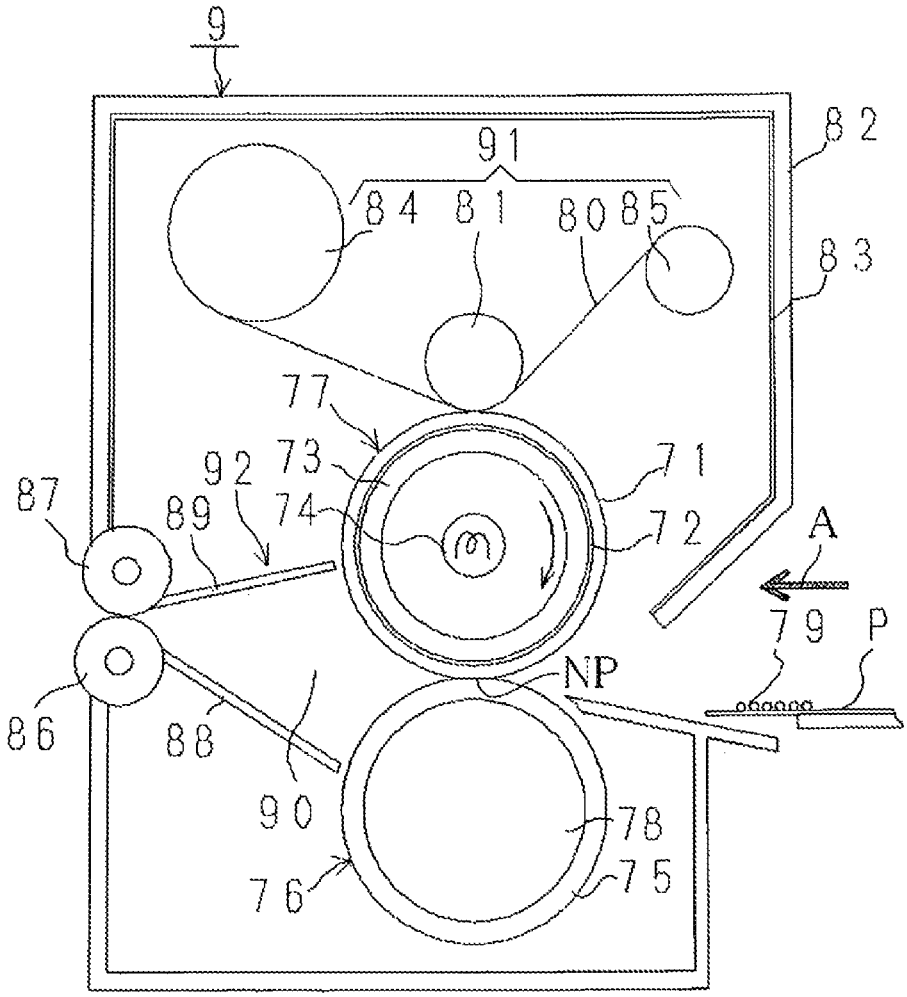
FIG. 2 is a cross-sectional view of a fixing device taken along the sheet conveying direction.

FIG. 2 is a cross-sectional view of the fixing device taken along the sheet conveying direction.

The fixing device 9 is a heat fixing device configured to fix the toner image onto the sheet by heating and pressurizing the sheet while a pressure roller 76 and a fixing roller 77 are nipping the sheet and rotating in pairs. In place of the fixing roller 77, a film cylinder containing a heat source 74 to be described later may be used.

The fixing roller 77 is situated on the upper side of the pressure roller 76, and on the side of the photosensitive drums 3*a*, 3*b*, 3*c*, and 3*d* (FIG. 1). The fixing roller 77 includes a halogen heater as the heat source 74 arranged inside the fixing roller 77. The pressure roller 76 is formed by coating the outer circumference of a cored bar 78 with an elastic member 75 such as rubber. The pressure roller 76 is held into pressure contact with the fixing roller 77 to form a nip together with the fixing roller 77. The fixing roller 77 receives a rotational force from the main body of the image forming apparatus by a drive unit (not shown), to thereby rotate in the arrow direction of FIG. 2. During the rotation, the surface of the fixing roller 77 is maintained at a substantially constant temperature by a thermistor (not shown) or the like. The sheet P having a toner image 79 transferred from the transfer belt 130 is nipped and conveyed at a nip NP between the fixing roller 77 and the pressure roller 76. The toner image 79 is fixed onto the sheet P by heat of the heat source 74 and a nip pressure between the fixing roller 77 and the pressure roller 76.

The fixing roller 77 includes a coating resin layer 71 as an outermost layer so as to prevent the toner image 79 from adhering to the fixing roller 77. The coating resin layer 71 is attached to a cored bar 73 by a primer layer 72 made of an adhesive. For the coating resin layer 71, a silicone rubber, or a fluorine resin film or tube is used. Examples of the fluorine resin material to be used preferably include perfluoroalkoxy (PFA), polytetrafluoroethylene (PTFE), and a tetrafluoroethylene-hexafluoropropylene copolymer (FEP).

Further, the fixing device 9 generally includes a mold releasing agent applying portion 91 for applying a mold releasing agent such as silicone oil to the coating resin layer 71. The mold releasing agent applying portion 91 includes a cleaning web 80 impregnated with the mold releasing agent, a web supplying roller 85 around which the web 80 is wound, a take-up roller 84 for taking up the web 80, and a web pressure roller 81 for pressing the web 80 against the fixing roller 77. The mold releasing agent applying portion 91 gradually feeds the web 80 according to a copy operation to apply the mold releasing agent to the fixing roller 77 and remove the developer adhering to the fixing roller 77 through the rotation of the fixing roller 77.

Note that, in a case of a cleaning-free fixing device, the fixing device does not include the mold releasing agent applying portion 91, and prevents the developer from adhering thereto only by releasability of the surface of the fixing roller 77 instead.

Thus, the image forming apparatus of the present invention may employ the cleaning-free fixing device as the fixing device.

In the fixing device 9, the heat source 74 may emit a large amount of heat so that the respective members around the fixing device 9 may be heated and deformed, or the toner may unnecessarily be fused. In order to prevent such cases, the fixing device 9 includes a heat insulating cover 83 provided on an upper inner wall of a housing 82.

On the downstream side of the fixing device 9 in the sheet conveying direction, there are provided a lower guide unit 88 and an upper guide unit 89 for guiding the sheet P to the downstream side. Further, a pair of post-transfer rollers 86 and 87 are provided on the downstream side. Between the lower guide unit 88 and the upper guide unit 89, a sheet conveying region 90 is formed.

(Sheet Guiding Device)

Figure 3:
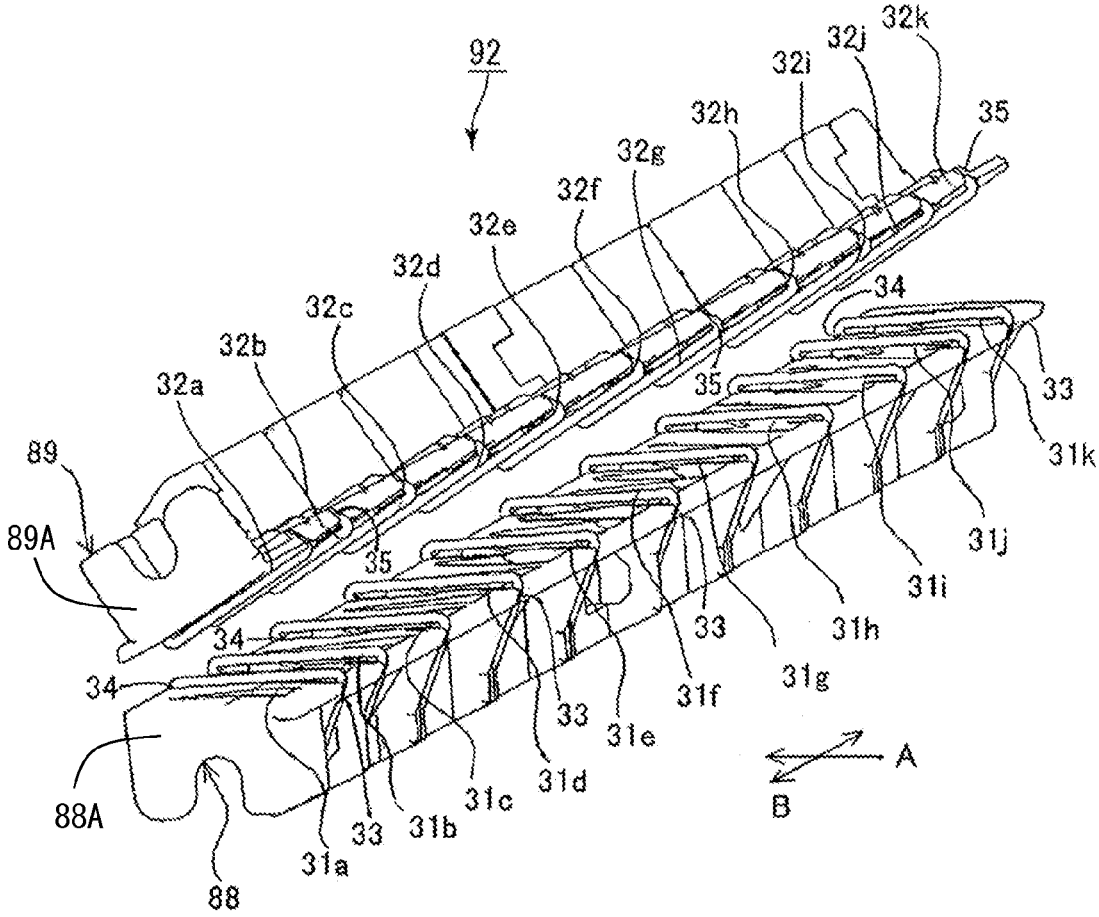
FIG. 3 is a perspective view of an appearance of a sheet guiding device according to the embodiment of the present invention.

FIG. 3 is a perspective view of an appearance of a sheet guiding device according to the embodiment of the present invention. A sheet guiding device 92 is constituted by the lower guide unit 88 and the upper guide unit 89. The lower guide unit 88 includes ribs 31*a* to 31*k* serving as a wire-shaped guide, and a holder 88A for holding the ribs 31*a* to 31*k*. The upper guide unit 89 includes ribs 32*a* to 32*k* serving as a wire-shaped guide, and a holder 89A for holding the ribs 32*a* to 32*k*.

Hereinafter, the lower guide unit 88 and the upper guide unit 89 are simply referred to as "guides 88 and 89". Further, the ribs are collectively referred to as "ribs 31 and 32".

The holders 88A and 89A are elongated members arranged so as to intersect the sheet conveying direction. The holders 88A and 89A are members made of heat-resistant plastic having a low heat capacity, such as polyethylene terephthalate (PET) and polyphenylene sulfide (PPS). Note that, the holders 88A and 89A may be a guide plate made of metal.

On a sheet passing side of the lower guide unit (upper side of the lower guide unit 88), the plurality of ribs 31*a* to 31*k* are provided side by side in a direction (arrow B direction) intersecting the sheet conveying direction (arrow A direction). The plurality of ribs 31*a* to 31*k* are removably mounted to the holder 88A. Similarly, on the sheet passing side of the upper guide unit 89 (lower side of the upper guide unit 89), the plurality of ribs 32*a* to 32*k* are provided side by side in the direction intersecting the sheet conveying direction. The plurality of ribs 32*a* to 32*k* serving as the wire-shaped guide are removably mounted to the holder 89A.

The plurality of ribs 31 and 32 arranged in the arrow B direction guide the sheet P that is sent out through the fixing device 9. In this case, the sheet is conveyed while rubbing against at least one of the ribs 31 and 32.

Figure 7:
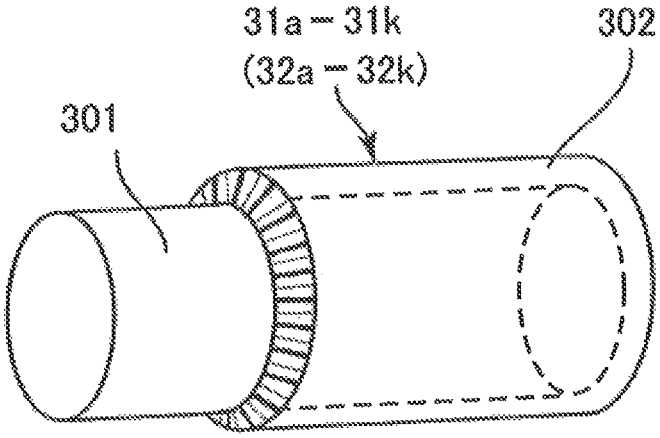
FIG. 7 is a detailed view of part of the rib.

Referring to FIG. 7, the ribs 31 and 32 are each formed into a linear shape by an elastic, exothermic cored wire 301 having a wire diameter of about 0.5 mm to 1 mm, and a coating portion 302 formed by coating the cored wire 301 with a fluorine-based resin having a thickness of about 0.05 mm to 0.5 mm.

A piano wire is suitable for the cored wire 301. Further, an exothermic iron-chromium-aluminum-based or nickel-chromium-based metal wire may be used for the cored wire 301. Further, a phosphor bronze wire made of copper, which has some elasticity and a higher thermal conductivity, may be used for the cored wire 301 because, once the ribs 31 and 32 are mounted to the guides 88 and 89, the ribs 31 and 32 are less frequently removed and mounted again. Note that, the ribs 31 and 32 are elastic due to the elasticity of the coating portion 302 made of the fluorine-based resin as well as the elasticity of the cored wire 301, and hence are elastic to some extent and mountable to and removable from the guides 88 and 89, respectively, even when the phosphor bronze wire is used for the cored wire 301.

Examples of the fluorine-based resin include perfluoroalkoxy (PFA), polytetrafluoroethylene (PTFE), and a tetrafluoroethylene-hexafluoropropylene copolymer (FEP). In the case of the PFA resin, when the PFA resin is too thin, coating durability is low, but when the PFA resin is too thick, as described later, the PFA resin is likely to be torn if the ribs 31 and 32 are bent. Therefore, it is preferred that the thickness of the PFA resin be about 0.2 mm.

By using the wire made of metal for the cored wire 301, when the fixing device 9 shifts from a cooled state to a heated state, in which the toner image is fixable onto the sheet, the temperature of the ribs 31 and 32 increases easily, with the result that the ribs 31 and 32 can prevent moisture condensation by themselves. Further, the cored wire 301 of each of the ribs 31 and 32 is coated with the fluorine-based resin, and hence the surface of each of the ribs 31 and 32 has a lower coefficient of thermal conductivity, with the result that the moisture condensation is less likely to occur and the toner is less likely to adhere. Further, excellent abrasion resistance is obtained.

The ribs 31 and 32 are each manufactured by applying a fluorine resin around a cored wire made of metal through coat molding to form the resultant into a wire shape, then bending the wire into a desired shape, and cutting the wire. Alternatively, the ribs 31 and 32 are each formed through cutting followed by bending into a predetermined shape. When a fluorocarbon-based resin, which may facilitate injection molding, is used among the fluorine resins as the fluorine resin to be applied around the cored wire, the coating thickness with respect to the cored wire 301 can be kept uniform. For this reason, it is preferred that the fluorocarbon-based resin be used for coating.

The ribs 31 and 32 thus manufactured can be formed into various shapes, and hence can be used in various shapes according to various positions of arrangement within the image forming apparatus, as well as for the sheet guiding device 92.

Figure 4:
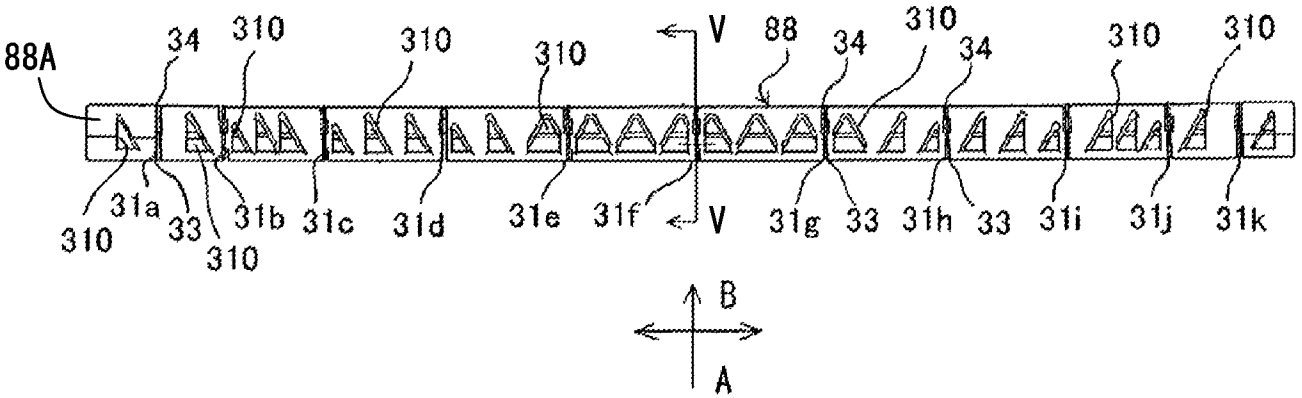
FIG. 4 is a plan view of a lower guide unit of the sheet guiding device of FIG. 3 as viewed from a sheet passing side.
Figure 5:
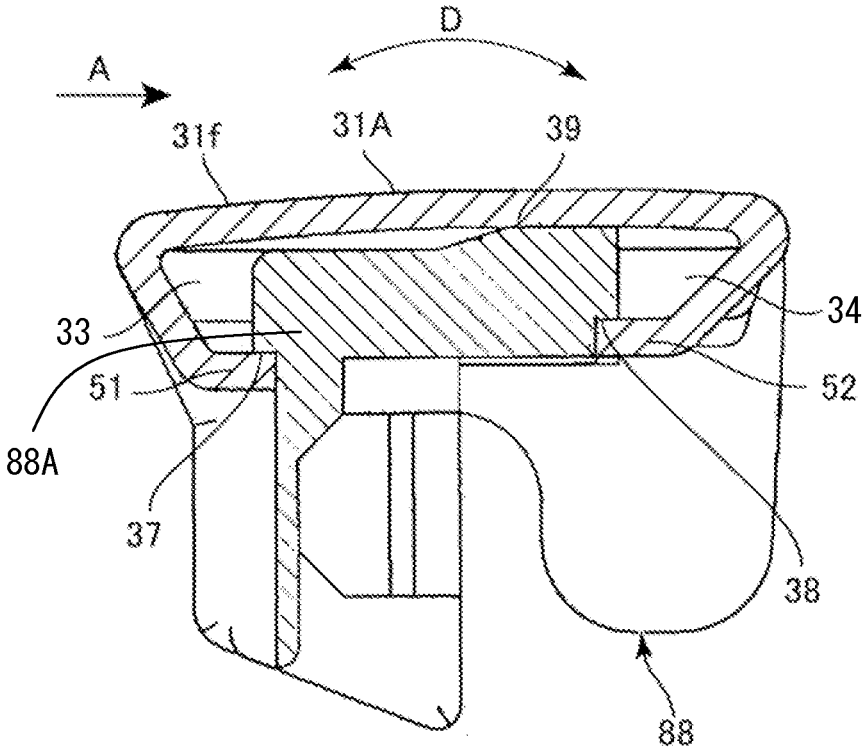
FIG. 5 is a cross-sectional view taken along the line V-V of FIG. 4, illustrating a relationship between the lower guide unit and a rib.

Referring to FIGS. 4 and 5, a procedure of mounting the ribs 31*a* to 31*k* and the ribs 32*a* to 32*k* respectively to the holder 88A and the holder 89A will be described. FIG. 4 is a plan view of the lower guide unit 88 of the sheet guiding device of FIG. 3 as viewed from the sheet passing side. FIG. 5 is a cross-sectional view taken along the line V-V of FIG. 4, illustrating a relationship in which the rib 31*f* is mounted to the lower guide unit 88.

Note that, the lower guide unit 88 and the upper guide unit 89 have horizontally symmetric shapes across the sheet conveying region 90. Similarly, the ribs 31*a* to 31*k* and the ribs 32*a* to 32*k* have horizontally symmetric shapes across the sheet conveying region 90. Hence, the procedure of mounting the ribs 31*a* to 31*k* to the holder 88A is similar to the procedure of mounting the ribs 32*a* to 32*k* to the holder 89A. Therefore, the shape of the holder 88A and the procedure of mounting the ribs 31*a* to 31*k* to the holder 88A will be described, and description of the shape of the holder 89A and the procedure of mounting the ribs 32*a* to 32*k* to the holder 89A is partially omitted herein.

On the upstream side and the downstream side of the holder 88A, there are respectively formed as many grooves 33 and 34 as the number of the ribs. The ribs 31*a* to 31*k* are each engaged with the grooves 33 and 34, and the grooves 33 and 34 are arranged at regular intervals in the direction intersecting the sheet conveying direction. Hence, the grooves 33 and 34 are formed at regular intervals except for both ends (both sides of FIG. 4). Further, the grooves 33 and 34 are formed in order to prevent the ribs 31 from being inclined in the direction intersecting the sheet conveying direction. Further, the grooves 33 and 34 are formed so that the ribs 31 are oriented along the sheet conveying direction or oriented obliquely.

Also in the holder 89A, there are formed grooves and 36 (the groove 36 is not shown) similar to the grooves 33 and 34.

On the upstream side and the downstream side of the holder 88A in the sheet conveying direction, there are respectively formed as many recessed portions 37 and 38 as the number of the ribs 31, the recessed portions 37 and 38 serving as engaged portions. At a position on the sheet passing side between the upstream and downstream recessed portions 37 and 38, there are formed as many protrusions 39 as the number of the ribs 31, the protrusion 39 serving as an abutment surface. Each protrusion 39 is formed slightly on a downstream side with respect to the center of the guide 88 in the sheet conveying direction. Similarly, in the holder 89A, there are formed recessed portions (not shown) and protrusions (not shown). Note that, the protrusions 39 are not necessarily formed individually in correspondence with the respective recessed portions 37 and 38, but a ridge (protruding thread) continuously formed in the direction intersecting the sheet conveying direction may be provided instead. Further, the protrusion 39 may be an arc surface formed into a convex shape on the sheet passing side of the guide.

Each rib 31 is removably mounted to the holder 88A in the following manner. That is, the rib 31 is distorted in an arrow D direction against the elasticity in a state in which an intermediate portion of the rib 31 is received by the protrusion 39, and bent portions 51 and 52 that are bent at both ends of the rib 31 are engaged with the recessed portions 37 and 38, respectively, in a straddle state. The rib 31 is mounted by using an elastic force of the rib 31 itself. In other words, the rib 31 is mounted (mountable) to the guide 88 by the bent portions 51 and 52 being engaged with the recessed portions 37 and 38, respectively, by using a restoring force of the rib 31 itself. Each rib 32 is mounted (mountable) to the guide 89 in a similar manner. The ribs 31 and 32 are fixed to the holders 88A and 89A, respectively, in a state of vertically sandwiching the protrusion 39 and the recessed portions 37 and 38 by the elasticity of the ribs 31 and 32 themselves.

Each rib 31 is in contact with the holder 88A at three points, that is, the recessed portion 37, the recessed portion 38, and the protrusion 39. Thus, even when the rib 31 is heated by radiation heat from the fixing device 9 or heat received from the sheet P, the heat which heats the rib 31 is hardly transferred to the holder 88A. In the rib 31, the cored wire 301 made of metal is easily heated, and the coating portion 302 that is the PFA resin coating the cored wire 301 prevents heat dispersion. Thus, the rib 31 is maintained at high temperature and the moisture condensation is less likely to occur. Similarly, in the case of the rib 32, the moisture condensation is less likely to occur.

The holder 88A has a large number of through-holes 310 (FIG. 4) formed therein. The through-holes 310 are formed in a direction (thickness direction of the holder 88A) intersecting the sheet conveying direction and the arrangement direction of the guide members. The through-holes 310 are formed so that the moisture vaporized from the sheet P heated by the heat of the fixing device 9 passes through the holder 88A and diffuses within the image forming apparatus 50, to thereby suppress local increase in humidity. The through-holes 310 are also formed in the holder 89A, to thereby suppress local increase in humidity. By preventing the local increase in humidity in the holders 88A and 89A, the moisture condensation is less likely to occur in the sheet guiding device 92.

As described above, the cored wire of each rib is heated by the heat of the fixing device, and the coating of the fluorine-based resin retains the heat of the cored wire. Thus, the moisture condensation is less likely to occur in the rib, and the sheet guiding device 92 can smoothly guide the sheet without damaging the toner image.

Further, the ribs 31 and 32 are removably provided to the lower guide unit 88 and the upper guide unit 89, respectively, and hence the sheet guiding device 92 is manufacturable with ease even when the ribs 31 and 32 and the holders 88A and 89A are downsized.

In this case, the ribs 31 and 32 are brought into contact with the holders 88A and 89A at three points, respectively, that is, the ribs 31 and 32 are engaged with the recessed portions 37 and 38 of the respective holders 88A and 89A against the elasticity in the state in which the intermediate portion is received by the protrusion 39. Thus, the ribs 31 and 32 are reliably mounted to the holders 88A and 89A, respectively, by the elasticity of the ribs 31 and 32 themselves. The ribs 31 and 32 are fixed to the holders 88A and 89A, respectively, in the state of sandwiching the protrusion 39 and the recessed portions 37 and 38 by the elasticity of the ribs 31 and 32 themselves. Thus, even when the sheet passes while coming into contact with the ribs 31 and 32, the ribs 31 and 32 hardly shake with respect to the holders 88A and 89A, respectively, and accordingly the sheet guiding device 92 can reliably guide the sheet.

Further, the ribs 31 and 32 are mounted to the holders 88A and 89A, respectively, in the state in which the intermediate portion is received by the protrusion 39. Thus, the heights of intermediate parts 31A (FIG. 5), through which the sheet is guided, can be kept uniform. Specifically, the positions of the intermediate parts 31A of the respective ribs 31 and 32 in a thickness direction of the sheet, which come into contact with the conveyed sheet, are reliably aligned by the protrusions 39. Thus, the sheet guiding device 92 can smoothly guide the sheet.

Further, the ribs 31 and 32 are in contact with the holders 88A and 89A at three points, respectively, and hence, even when the ribs 31 and 32 are heated by the radiation heat from the fixing device 9 or the heat received from the sheet P, the heat which heats the ribs 31 and 32 is hardly transferred to the holders 88A and 89A. Thus, the moisture condensation hardly occurs on the ribs 31 and 32, and accordingly the sheet guiding device 92 can smoothly guide the sheet without wetting the sheet.

Further, the protrusion 39 is formed slightly on the downstream side with respect to the center of the holder 88A in the sheet conveying direction. Hence, a gap between the opposing ribs 31 and 32 is gradually reduced from the upstream side toward the downstream side of the sheet conveying direction. Thus, the sheet guiding device 92 can smoothly guide the sheet.

Further, the ribs 31 and 32 of the present invention are each formed by coating the cored wire 301 with the fluorine-based resin, bending the wire having the coating portion 302 formed thereon into a desired rib shape, and cutting the wire. Then, the ribs 31 and 32 thus formed are mounted to the holders 88A and 89A, respectively. Thus, the thickness of the coating portion 302 is uniform, and the ribs 31 and 32 each have a smooth surface. As a result, the sheet jam due to snagging of the sheet can be suppressed.

Figure 6:
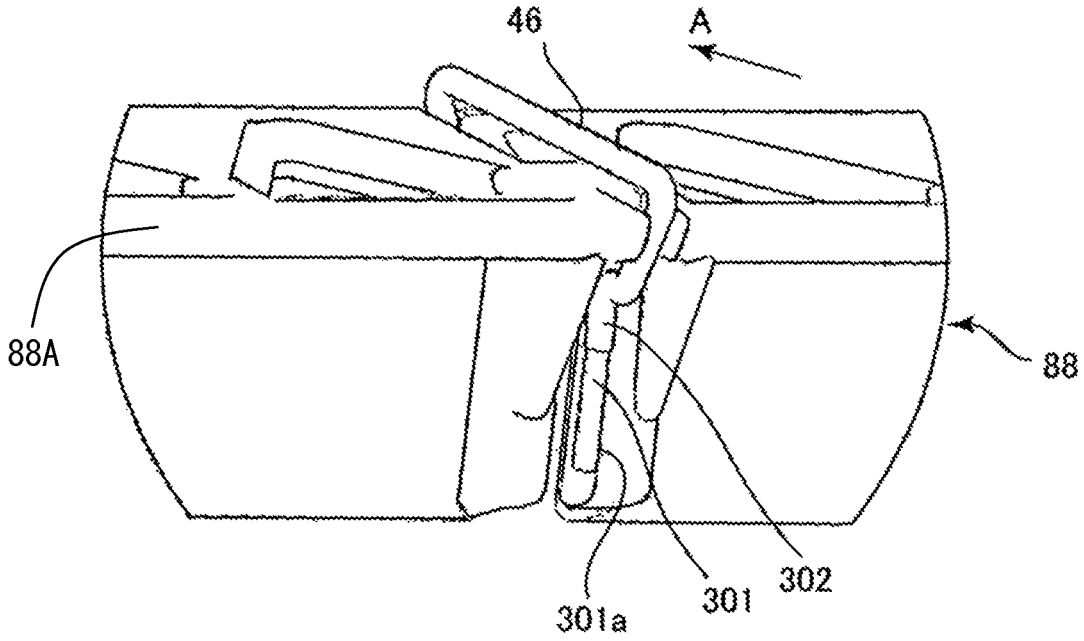
FIG. 6 is a view illustrating that an exposed portion, in which a cored wire is exposed, is formed in an end portion of the rib.

Note that, the ribs 31 and 32 of the above-mentioned embodiment may instead be a rib 46 illustrated in FIG. 6. The rib 46 includes an exposed portion 301*a* having no coating portion 302 applied thereto, and provided in an end portion of the cored wire 301 on the fixing device side (upstream side in the sheet conveying direction).

With this structure, the exposed portion 301*a* can rapidly absorb the radiation heat of the fixing device 9 when the image forming apparatus is activated in the stopped and cooled state. Accordingly, the rib 46 is heated rapidly. In general, when the image forming apparatus starts an image forming operation in a state in which the rib is not heated sufficiently, the moisture vaporized from the sheet passing through the fixing device comes into contact with the cooled rib to cause the moisture condensation. However, as in the case of the rib 46 illustrated in FIG. 6, which is heated rapidly, the image forming apparatus can start the image forming operation rapidly.

In the above-mentioned sheet guiding device 92, by using the radiation heat from the fixing device 9 to heat the ribs 31 and 32, the moisture condensation is less likely to occur on the ribs 31 and 32.

In another sheet guiding device 192 described next, in addition to the heating by the radiation heat from the fixing device 9, a current is allowed to flow through the ribs 31 and 32 so that the ribs 31 and 32 actively generate heat. As a result, the moisture condensation is less likely to occur on the ribs 31 and 32. In the sheet guiding device 192, the same components as those of the above-mentioned sheet guiding device 92 are represented by the same reference symbols, and description thereof is therefore omitted herein.

Figure 8:
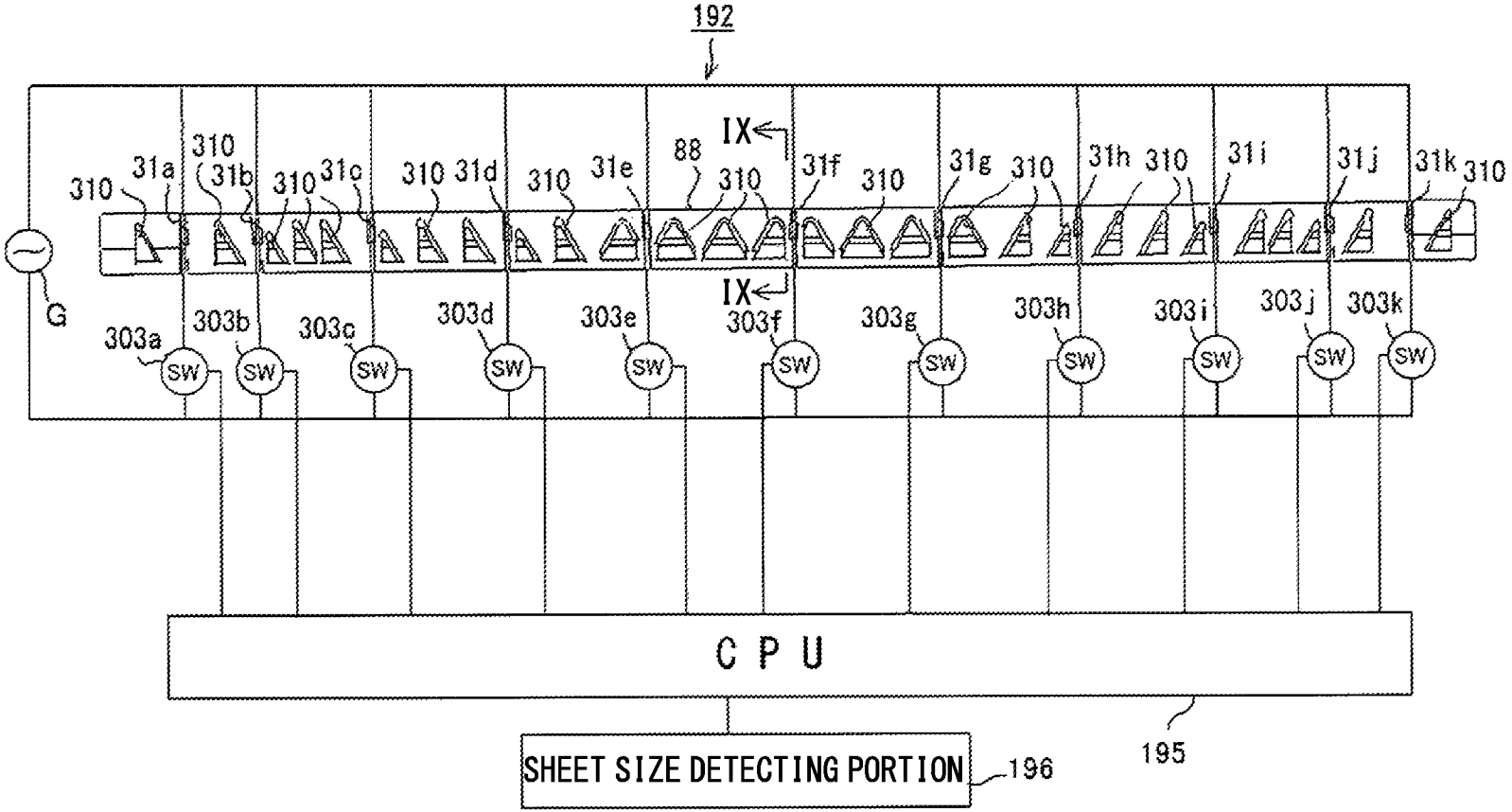
FIG. 8 is a plan view of ribs and a lower guide unit of another sheet guiding device, corresponding to FIG. 4.
Figure 9:
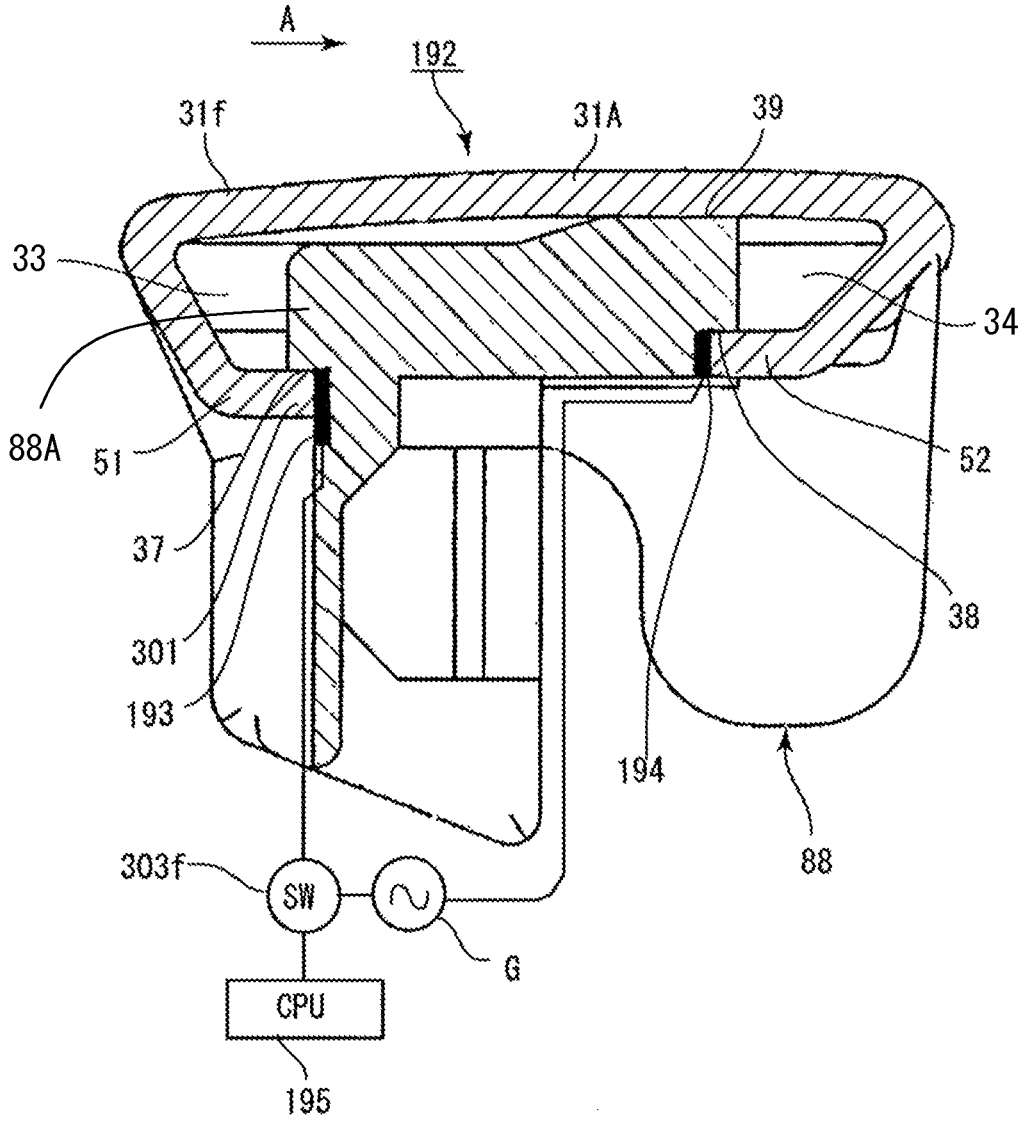
FIG. 9 is a cross-sectional view taken along the line IX-IX of FIG. 8.

FIG. 8 is a plan view of ribs and a lower guide unit of the another sheet guiding device 192, corresponding to FIG. 4 illustrating the above-mentioned sheet guiding device 92. FIG. 9 is a cross-sectional view taken along the line IX-IX of FIG. 8.

Referring to FIG. 9, in the recessed portions 37 and 38 of the holder 88A with which the bent portions 51 and 52 of the rib 31*f* are engaged (engageable), respectively, there are provided electrodes 193 and 194 with which the cored wire 301 of the rib 31*f* is in contact. A switch 303*f* and a power source G are connected to the electrodes 193 and 194. The electrodes 193 and 194, the switch 303*f*, and the power source G constitute a closed circuit. Note that, when a guide plate made of metal is used for the holders 88A and 89A, the electrodes 193 and 194 are provided to the guide plate through the intermediation of an insulating member.

A plurality of electrodes 193 and 194 are provided so that the individual cored wires 301 of the ribs 31*a* to 31*k* are brought into contact with the upstream and downstream recessed portions 37 and 38 of the holder 88A with which the ribs 31*a* to 31*k* are engaged. The respective cored wires 301 of the ribs 31*a* to 31*k* are in contact with the electrodes 193 and 194 by the elastic force of the ribs. Further, referring to FIG. 8, switches 303*a* to 303*k* and the power source G constituting the closed circuit are connected to the respective electrodes 193 and 194.

The respective switches 303*a* to 303*k* are turned ON and OFF through selection by a CPU 195 serving as a switch selecting unit. A sheet size detecting portion 196 configured to detect the width of the sheet (length in the direction intersecting the sheet conveying direction) is connected to the CPU 195. The sheet size detecting portion 196 is provided on the upstream side of the sheet guiding device 192 in the sheet conveying direction.

The coating portion of each of the ribs 31*a* to 31*k* serves also as an insulating portion, to thereby insulate the cored wire from the holder 88A. Further, the coating portion may be omitted on the fixing device 9 side of the ribs 31*a* to 31*k* so that the cored wire is heated rapidly by the heat of the fixing device 9. However, it is necessary to consider a positional relationship so that other members do not come into contact with the portion in which the cored wire is exposed.

Similarly, a plurality of electrodes with which the individual ribs are brought into contact are provided in the upper guide unit (not shown). The respective electrodes constitute the closed circuit together with the switch and the power source. Further, the respective switches are turned ON and OFF through the selection by the CPU 195.

Note that, the CPU 195 and the sheet size detecting portion 196 are shared in use by the lower guide unit 88 and the upper guide unit 89.

Figure 10A:
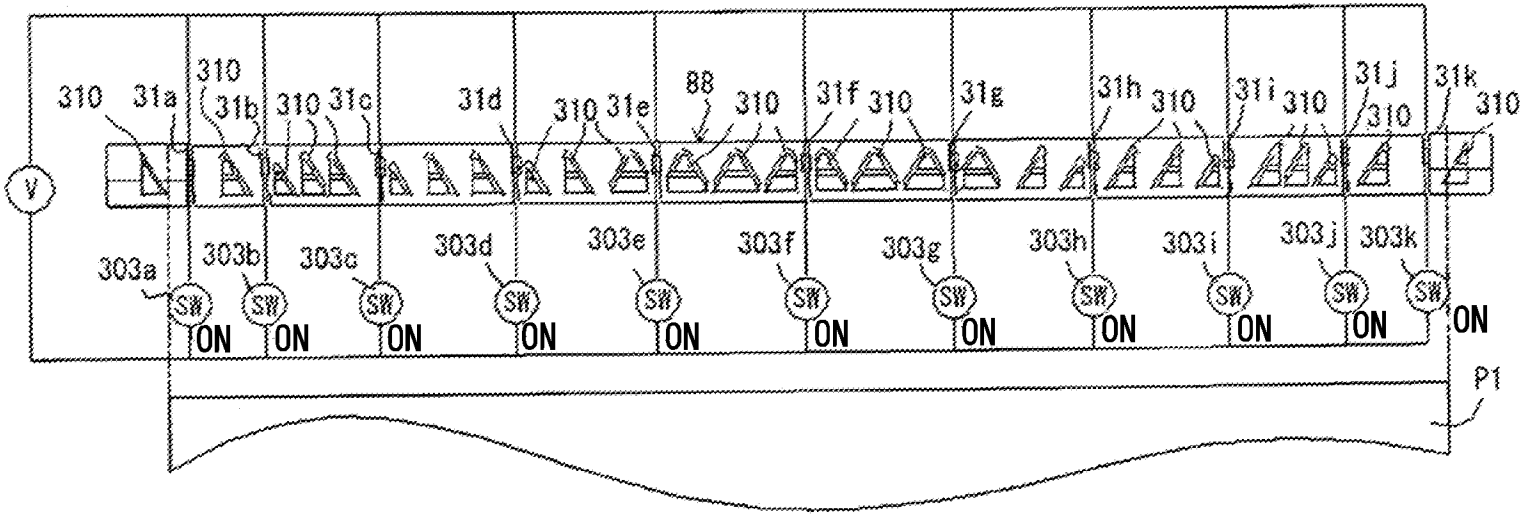
FIGS. 10A and 10B are explanatory views of an operation to be performed when the sheet guiding device of FIG. 8 guides sheets having different widths.
Figure 10B:
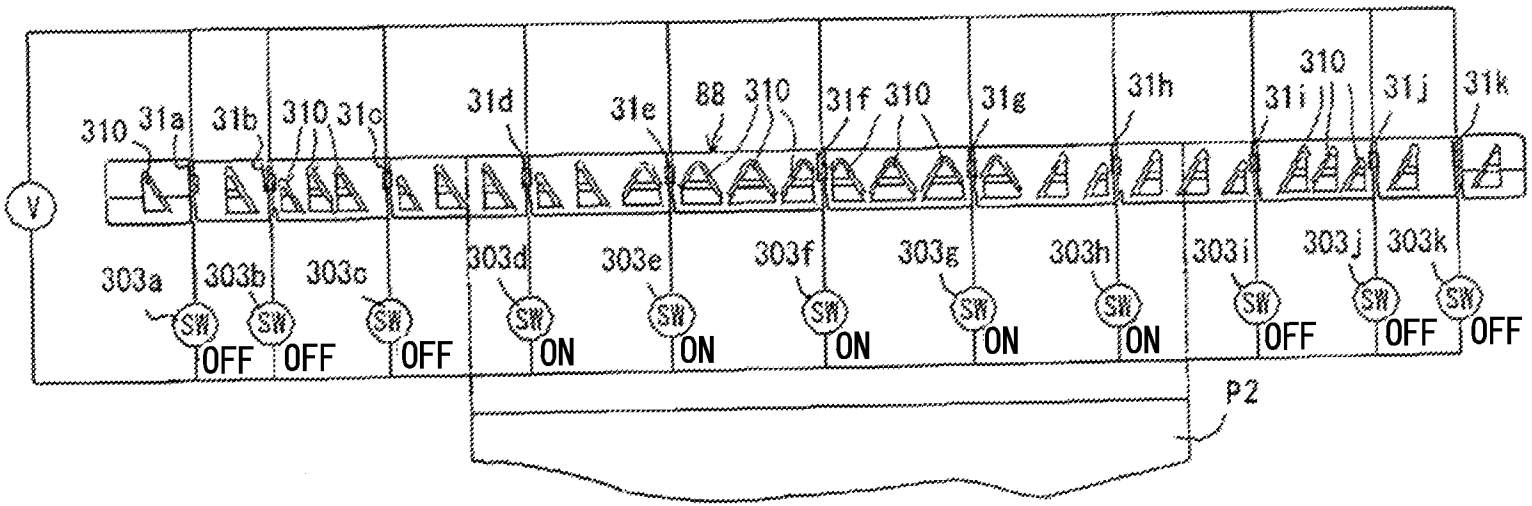
Figure 11:
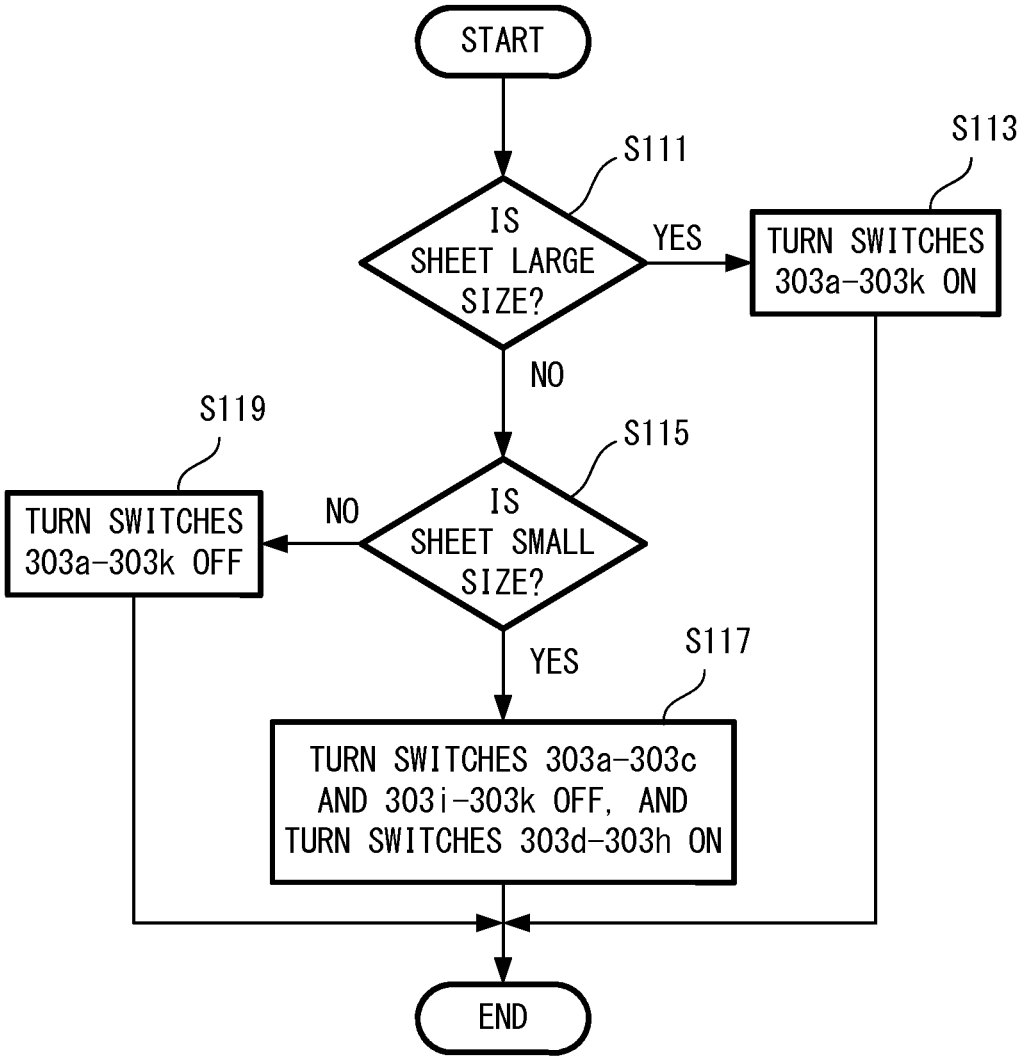
FIG. 11 is an explanatory flow chart of the operation to be performed when the sheet guiding device of FIG. 8 guides a sheet.

Referring to FIGS. 10A, 10B, and 11, an operation of the sheet guiding device 192 will be described. FIGS. 10A and 10B are explanatory views of an operation to be performed when the sheet guiding device of FIG. 8 guides sheets having different widths. FIG. 11 is an explanatory flow chart of the operation to be performed when the sheet guiding device of FIG. 8 guides a sheet.

Before a sheet enters the fixing device 9 or when the sheet exits the fixing device 9, the sheet size detecting portion 196 detects the width of the sheet. Based on information on the width of the sheet from the sheet size detecting portion 196, the CPU 195 selects the switches in a region corresponding to the width of the sheet to turn ON the selected switches.

Referring to FIG. 10A, in a case of a sheet P1 of a large width ("YES" in S111), the CPU 195 selects all the switches 303*a* to 303*k* to turn ON the selected switches 303*a* to 303*k* (S113). A current flows through the ribs 31*a* to 31*k* whose switches are turned ON, with the result that the cored wires 301 of the respective ribs generate heat.

Referring to FIG. 10B, in a case of a sheet P2 of a small width ("NO" in S111 and "YES" in S115), the CPU 195 selects the switches 303*d* to 303*h* in a region corresponding to the width of the sheet to turn ON the selected switches 303*d* to 303*h*. Then, the other switches 303*a* to 303*c* and 303*i* to 303*k* are left OFF (S117). A current flows through the ribs 31*d* to 31*h* whose switches are turned ON, with the result that the cored wires 301 of the respective ribs generate heat.

When the sheet is not conveyed ("NO" in both S111 and S115), the CPU 195 leaves all the switches 303*a* to 303*k* OFF (S119).

Similarly, in the case of the upper guide unit, the CPU 195 selects the switches according to the width of the sheet so that the ribs generate heat.

With this structure, even when the moisture vaporized from the sheet adheres to the ribs, the ribs that have generated heat rapidly vaporize the moisture, and thus the moisture condensation is less likely to occur. Accordingly, similarly to the above-mentioned sheet guiding device 92, the sheet guiding device 192 can smoothly guide the sheet without causing any trouble with the sheet guiding due to the moisture condensation.

Note that, the ribs through which the current is allowed to flow are selected according to the width of the sheet for the following reason.

In the case of guiding a sheet of a small width, there are ribs with which the sheet does not come into contact. Hence, when the current is allowed to flow through all the ribs, the heat of the ribs with which the sheet comes into contact is taken by the sheet to some extent, and the temperature of the ribs decreases. However, the heat of the ribs with which the sheet does not come into contact is not taken by the sheet, and the temperature of the ribs does not decrease. In this state, when the succeeding sheet has a large width, the sheet of the large width is guided and conveyed by the ribs with no temperature decrease as well as the ribs with temperature decrease. Therefore, part of the toner image passing through the ribs with no temperature decrease is fused to some extent, and the toner image is streaked. As a result, the image quality of the toner image is degraded.

For this reason, in the sheet guiding device 192, no current is allowed to flow through the ribs in a region not corresponding to the width of the sheet. Thus, the toner image is not streaked and the degradation of the image quality of the toner image is prevented. Further, no current is allowed to flow through the needless ribs, and thus power consumption can be reduced. Further, the temperature of the sheet guiding device 192 is not unnecessarily increased, and thus there is no need to use a highly heat-resistant, expensive member as the member to be provided around the sheet guiding device 192.

In the above description, the information on the width of the sheet is obtained through the detection by the sheet size detecting portion 196, but may instead be obtained from information regarding the sheet, which is input to the image forming apparatus by a user. Accordingly, the sheet size detecting portion 196 may be omitted.

Note that, the ribs are heated by the radiation heat of the fixing device 9 even if no current is applied thereto. Thus, in a case of low humidity in the image forming apparatus 50, the moisture condensation does not occur because the moisture adhering to the ribs vaporizes even when the ribs are not forcibly heated with a current flowing through the ribs.

Figure 12:
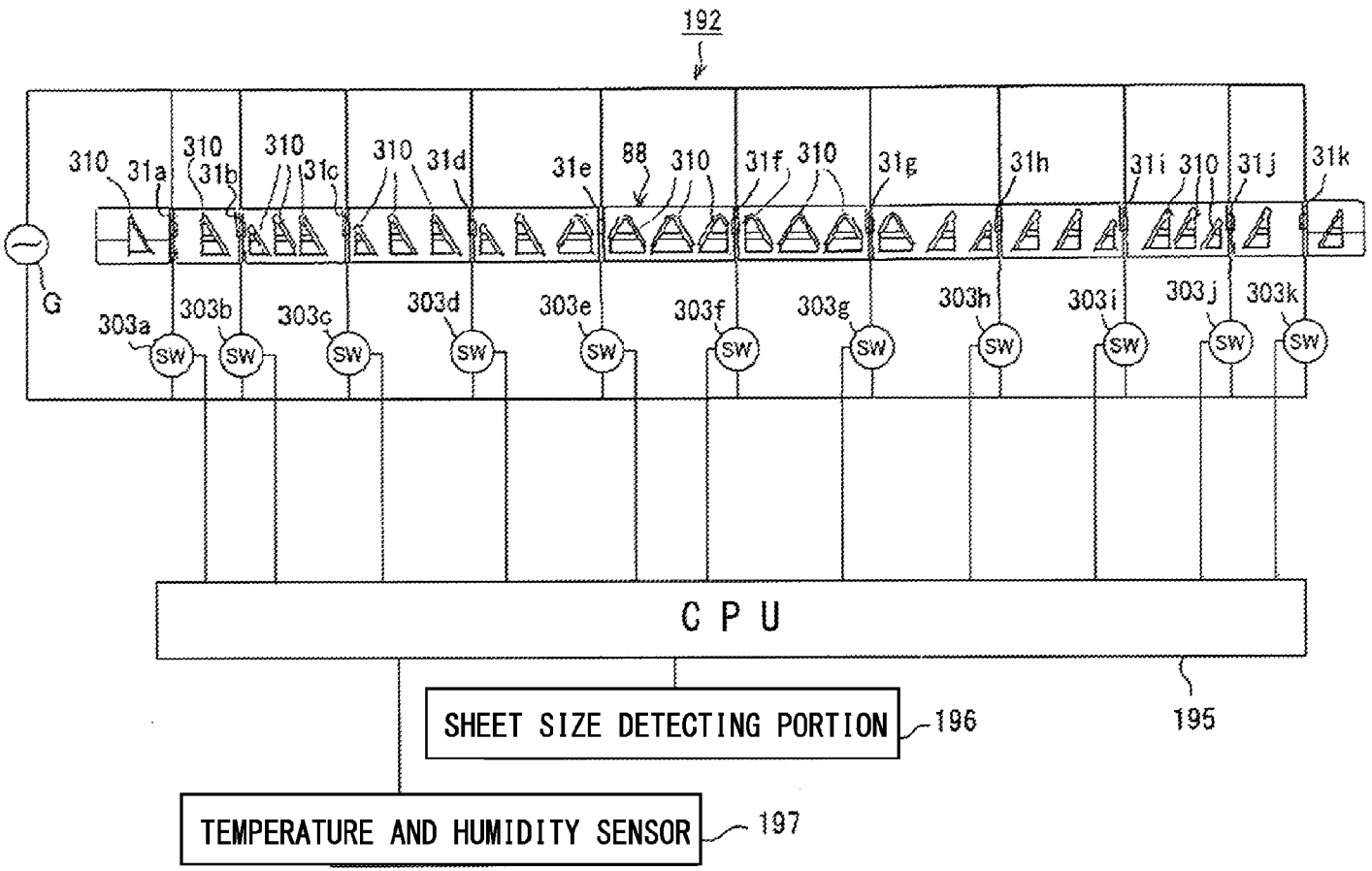
FIG. 12 is a view of the sheet guiding device of FIG. 8 provided with a temperature and humidity sensor.
Figure 13:
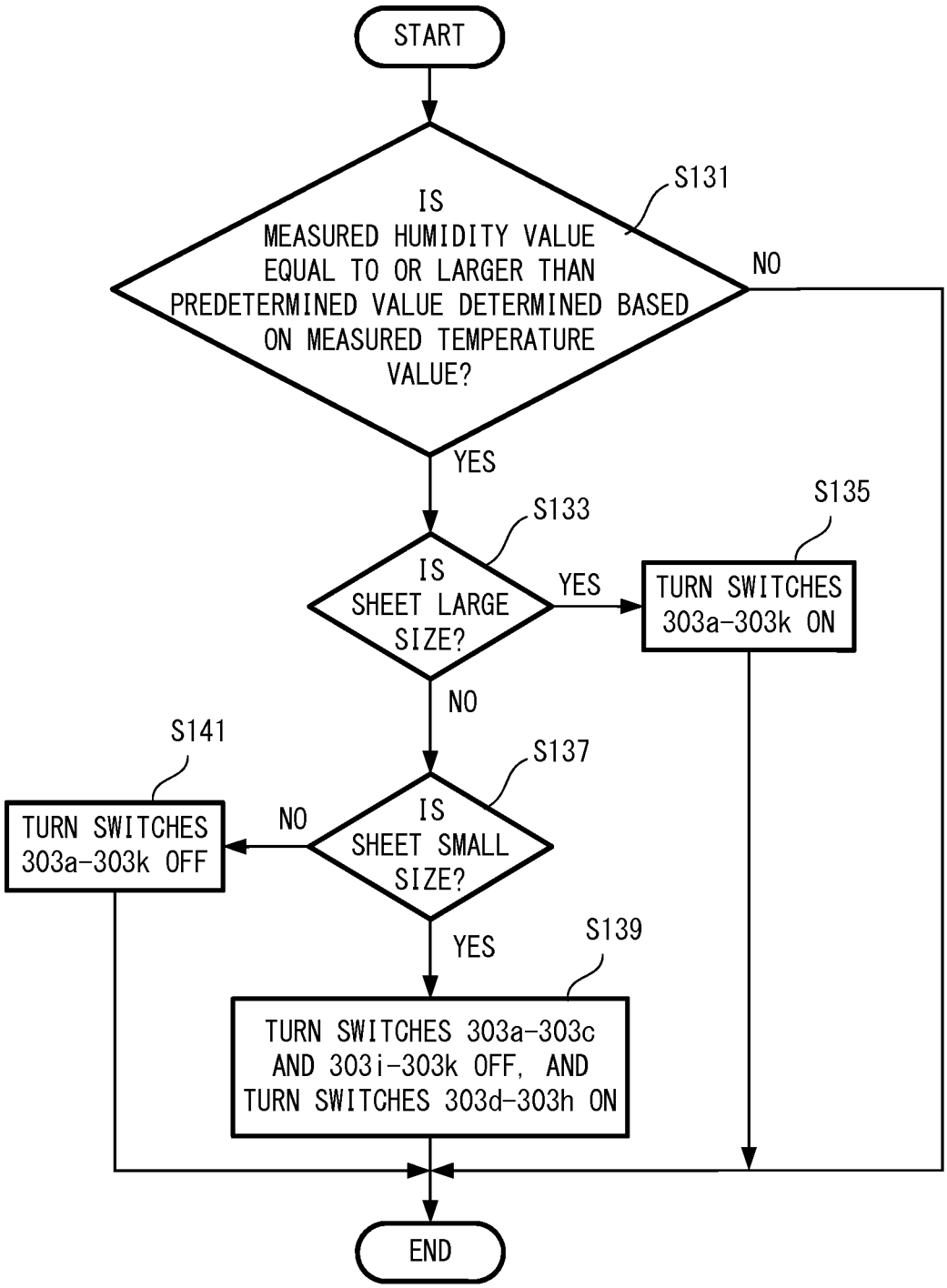
FIG. 13 is an explanatory flow chart of an operation to be performed in the case of FIG. 12.

Therefore, as illustrated in FIG. 12, a temperature and humidity sensor 197 serving as a temperature and humidity measuring unit configured to measure temperature and humidity is provided in the image forming apparatus 50. When the temperature and humidity sensor 197 detects that the value of the measured humidity in the image forming apparatus 50 becomes equal to or larger than a predetermined value determined based on the measured temperature ("YES" in S131 of FIG. 13), the CPU 195 causes a current to flow through the ribs (S133 to S141). Note that, processing of from S133 to S141 is the same as the processing of from S111 to S119, and description thereof is therefore omitted herein.

Note that, the predetermined value of humidity determined based on the temperature is a critical value at which the moisture condensation does not occur on the ribs. Accordingly, by providing the temperature and humidity sensor 197, in a temperature and humidity environment in which the moisture condensation does not occur, no current is allowed to flow so that unnecessary power is not used. As a result, power saving is achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-200123, filed Sep. 7, 2010, which is hereby incorporated by reference herein in its entirety.

What is claimed is:

1. An image forming apparatus comprising:

a fixing device configured to fix a toner image onto a sheet by heating the sheet having the toner image formed thereon;

a plurality of wires configured to guide the sheet having the toner image fixed thereto, the plurality of wires being arranged side by side in a direction intersecting a sheet conveying; and a holder configured to hold the plurality of wires wherein the holder comprises (i) a first engaged portion with which one end portion of each of the plurality of wires engages, (ii) a second engaged portion with which another end portion of each of the plurality of wires engages, and (iii) an abutting surface that abuts on a backside of a part of each of the plurality of wires, the part being configured to guide the sheet, wherein each of the plurality of wires is mounted to the holder by using an elastic force of the plurality of wires themselves.

2. An image forming apparatus according to claim 1, wherein each of the plurality of wires is formed by coating a metal with a resin.

3. An image forming apparatus according to claim 2, wherein part of each of the plurality of wires on the fixing device side is not coated with the resin.

4. An image forming apparatus according to claim 2, further comprising:

a plurality of electrodes with which the metals of the plurality of wires are individually brought into contact;

a plurality of switches each provided between each of the plurality of electrodes and a power source; and a switch selecting portion configured to select, from among the plurality of switches, switches in a region corresponding to a size of the sheet to turn ON and OFF the selected switches.

5. An image forming apparatus according to claim 4, further comprising a temperature and humidity measuring portion configured to measure temperature and humidity, wherein, when the humidity measured by the temperature and humidity measuring portion becomes equal to or larger than a predetermined value determined based on the temperature measured by the temperature and humidity measuring portion, the switch selecting portion selects the switches to turn ON and OFF the selected switches.

6. An image forming apparatus according to claim 1, wherein the abutting surface abuts the part between the one end portion and the other end portion of each of the plurality of wires.

7. An image forming apparatus according to claim 1, wherein each of the plurality of wires has a metal coated with a resin.

8. An image forming apparatus according to claim 1, wherein the abutting surface is provided on a downstream side with respect to a center of the holder in the sheet conveying direction.

9. An image forming apparatus according to claim 8, wherein the abutting surface protrudes towards a sheet conveyance path.

10. An image forming apparatus comprising: a fixing device configured to fix a toner image onto a sheet by heating the sheet having the toner image formed thereon;

a plurality of first wires configured to guide a first surface of the sheet, the plurality of first wires being arranged side by side in a direction intersecting a sheet conveying direction;

a plurality of second wires configured to guide a second surface, opposite to the first surface, of the sheet, the plurality of second wires being arranged side by side in the direction intersecting the sheet conveying direction;

a first holder configured to hold the plurality of first wires, the first holder comprising (i) a first engaged portion with which one end portion of each of the plurality of first wires engages, (ii) a second engaged portion with which another end portion of each of the plurality of first wires engages, and (iii) a first abutting surface that abuts on a backside of a part of each of the plurality of first wires, the part being configured to guide the first surface of the sheet, wherein each of the plurality of first wires is mounted to the holder by using an elastic force of the plurality of first wires themselves;

and a second holder configured to hold the plurality of second wires, the second holder comprising (i) a third engaged portion with which one end portion of each of the plurality of second wires engages, (ii) a fourth engaged portion with which another end portion of each of the plurality of second wires engages, and (iii) a second abutting surface that abuts on a backside of a part of each of the plurality of second wires, the part being configured to guide the second surface of the sheet, wherein each of the plurality of second wires is mounted to the holder by using an elastic force of the plurality of second wires themselves, wherein the first abutting surface and the second abutting surface are provided on a downstream side with respect to a center of the holder in the sheet conveying direction so that a gap between each of the plurality of first wires and a corresponding one of the plurality of second wires becomes narrower from an upstream side toward the downstream side in the sheet conveying direction.

11. An image forming apparatus according to claim 10, wherein the first abutting surface protrudes toward the second abutting surface and the second abutting surface protrudes toward the first abutting surface.

* * * * *